United States Patent [19]

Brown

[11] Patent Number: 5,044,037

[45] Date of Patent: Sep. 3, 1991

[54] MUSICAL TOOTHBRUSH

[75] Inventor: Kenneth A. Brown, West Simsbury, Conn.

[73] Assignee: U.S. Aqua Sports, Inc., Simsbury, Conn.

[21] Appl. No.: 406,296

[22] Filed: Sep. 12, 1989

[51] Int. Cl.[5] ..... A46B 9/04

[52] U.S. Cl. ..... 15/105; 15/167.1; 206/811; 434/263

[58] Field of Search ..... 15/105, 171, 167.1; 446/73, 81; 434/263; 206/811

[56] References Cited

U.S. PATENT DOCUMENTS

| | | | |
|---|---|---|---|
| 2,382,728 | 8/1945 | Kupchick | 206/811 |
| 2,877,477 | 3/1959 | Levin | 15/105 |
| 2,947,013 | 8/1960 | Silverman | 15/167.1 X |
| 3,368,670 | 2/1968 | Weaver | 206/811 |
| 4,341,230 | 7/1982 | Siahou | 15/167.1 X |
| 4,421,150 | 12/1983 | Masters | 206/811 |
| 4,554,919 | 11/1985 | Hubert . | |
| 4,679,273 | 7/1987 | Okin | 15/167.1 |
| 4,744,123 | 7/1988 | Wang et al. | 15/105 |
| 4,788,734 | 12/1988 | Bauer | 15/105 |
| 4,866,807 | 9/1989 | Kreit et al. . | |

FOREIGN PATENT DOCUMENTS

| | | | |
|---|---|---|---|
| 3149233 | 4/1983 | Fed. Rep. of Germany | 15/105 |
| 3236618 | 4/1984 | Fed. Rep. of Germany . | |

*Primary Examiner*—Harvey C. Hornsby
*Assistant Examiner*—Mark Spisich
*Attorney, Agent, or Firm*—Bachman & LaPointe

[57] ABSTRACT

The present invention relates to a novelty toothbrush. The toothbrush has a plastic member with a plurality of aligned holes at one end, a head and face portion at a second end and an integral handle for grasping the toothbrush. The toothbrush further has a series of bristles positioned within the holes for brushing teeth and massaging gums, a sound generator housed within the plastic member and a push-button device for actuating the sound generator to play a musical tune for a predetermined time period.

7 Claims, 1 Drawing Sheet

MUSICAL TOOTHBRUSH

BACKGROUND OF THE INVENTION

The present invention relates generally to toothbrushes and more particularly to a novelty toothbrush having a built-in music generator.

One of the most difficult tasks faced by parents and dentists is to instill good dental habits in children. Many children neglect proper dental care because they dislike brushing their teeth or simply forget about it. Often, children brush their teeth reluctantly as a result of parental pressure or coercion. The toothbrush of the present invention is designed primarily with children in mind, although it may also be used by adults, and is intended to improve children's dental habits in a fun manner.

Accordingly, it is an object of the present invention to provide a novelty toothbrush having a built-in music generator.

It is a further object of the present invention to provide a novelty toothbrush as above which will delight users by playing a musical tune for a predetermined time period.

It is yet a further object of the present invention to provide a novelty toothbrush as above having a pleasurable visual appearance.

It is still a further object of the present invention to provide a novelty toothbrush as above which is relatively simple to manufacture.

These and other objects and advantages will become more apparent from the following description and drawings in which like reference numerals depict like elements.

SUMMARY OF THE INVENTION

According to the present invention, a novel and useful toothbrush is provided. The toothbrush includes bristles for brushing one's teeth at a first end and a shape at a second opposed end in the form of a head and face of an object such as an animal or some other cartoon-like character. A handle for grasping the toothbrush lies between the bristles and the head and face design.

A sound generator such as a electronic-type music chip is located within a chamber formed by the head and face design and a removable cover. The sound generator is encased within a protective housing to prevent water and/or moisture damage. A push-button for depressing a spring-type actuating switch is incorporated into the head and face design. Preferably, the push-button forms the nose portion of the head and face. When depressed, the push button causes the switch to close the electrical circuit. Thereafter, the sound generator plays an audible musical tune such as a children's song or a portion thereof for a predetermined time period.

Further details of the toothbrush of the present invention will be provided hereinafter. It should of course be recognized that the drawings are for illustration purposes only and are not to be construed as defining the limits of the invention.

DETAILED DESCRIPTION OF THE INVENTION

Figure 4:
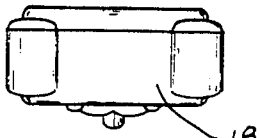
FIGS. 4 and 5 are respectively top and bottom views of the toothbrush of FIG. 1.
Figure 5:
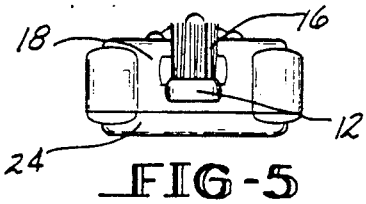
Figure 1:
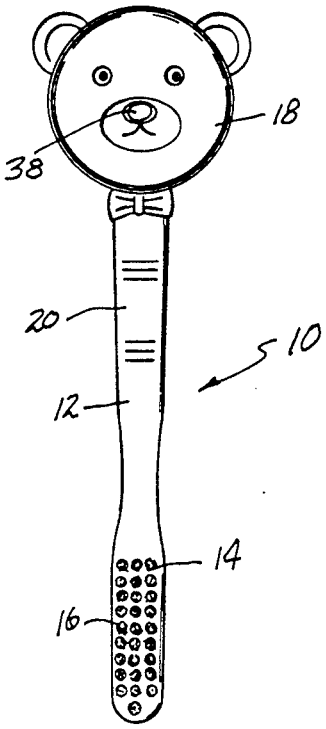
FIG. 1 is a front view of a toothbrush embodiment in accordance with the present invention.
Figure 3:
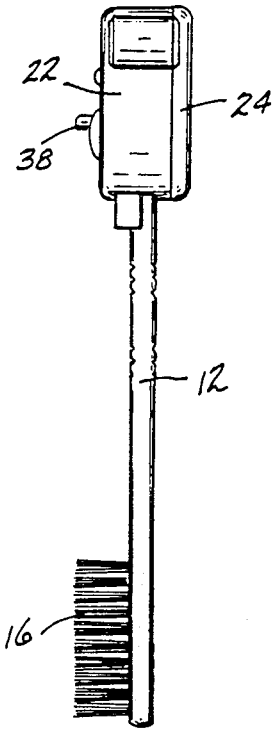
FIG. 3 is a side view of the toothbrush of FIG. 1.
Figure 2:
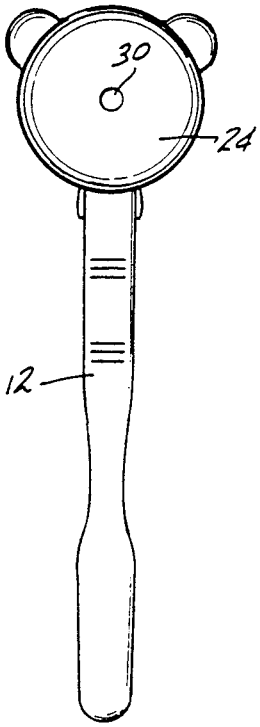
FIG. 2 is a rear view of the toothbrush of FIG. 1.

Referring now to the accompanying drawings, and embodiment of the toothbrush of the present invention is described below.

As shown in FIGS. 1–5, the novelty toothbrush 10 comprises an elongated member 12 having means 16 for brushing one's teeth and massaging one's gums at a first end and a head and face design 18 at a second opposed end. The brushing means 16 preferably comprises a plurality of bristles 16 adhesively affixed within a series of aligned holes or receptacles 14. The bristles 16 may be formed from any suitable material known in the art. For examples, they could be formed from a synthetic material such as nylon or from a natural material.

The member 12 includes a handle portion 20 lying intermediate the bristles 16 and the head and face portion 18. The handle portion 20 may have any desired length and any desired shape. While the toothbrush 10 is primarily intended for use by children, it may be designed for adult use by providing a slightly longer handle portion 20.

The head and face portion 18 of toothbrush may also have any desired shape. For example, it could have the teddy bear head and face shape shown in the figures. Alternatively, it could create the visual impression of a ghost-like figure, a mouse-like figure, a duck-like figure, a dog-like figure, a frog-like figure, or any other desired figure. There are essentially an infinite number of designs which could be incorporated into the toothbrush 10 to create desired visual impressions.

Figure 7:
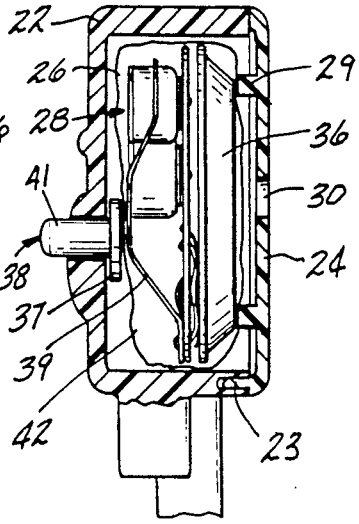
FIG. 7 is a cross sectional view of the head portion of the toothbrush of FIG. 1.
Figure 6:
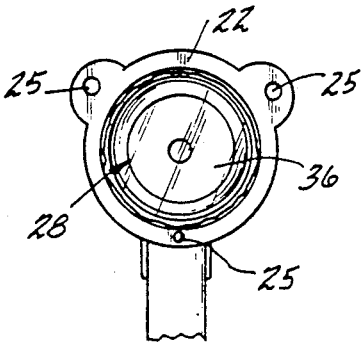
FIG. 6 is a rear view of the head portion of the toothbrush of FIG. 1.

As can be seen from FIG. 7, the head and face portion 18 of the toothbrush has a hollow interior. The hollow portion and a removable cover 24 define a chamber 26 for housing a sound generator 28. The cover 24 may be joined to the head and face portion 18 in any desired manner. For example, the cover may have three spaced apart pin connectors 23 for mating with three bores 25 in a rear surface 22 of the head and face portion 18. If desired, the pins may be omitted and the cover 24 may be adhesively affixed to the surface 22.

The cover 24 includes an aperture 30 through which sound emanating from the generator 28 may be heard. The cover 24 also includes one or more supports 29 for supporting and positioning the sound generator 28 in a desired position within the chamber 26.

The sound generator 28 may comprise any suitable device for creating an audible sound known in the art. Preferably, the generator 28 comprises an electronic music box circuit such as that shown in FIG. 8. Typically, the circuit includes a micro-cell 32 which serves as a source of power, an integrated circuit 34 for generating musical tones, a speaker unit 36 and a switch 39. Integrated circuits for generating musical tones and notes are well known in the art and therefore, the particulars of the circuit 34 do not form part of the present invention. Any desired circuit 34 may be used in the toothbrush of the present invention.

The sound generator 28 is encased within a sealed package 42 so as to prevent damage from the ingress of water, moisture, toothpaste, and the like. The package 42 may be formed from any suitable heat-sealable, impermeable, flexible material known in the art such as a plastic film material.

Figure 8:
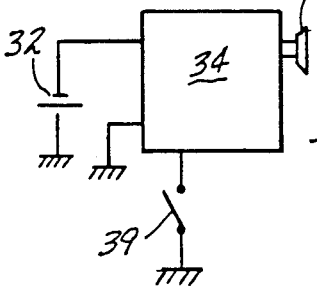
FIG. 8 is a simplified block diagram of the electrical circuit forming the sound generator.

As can been seen from FIG. 8, the actuating switch is formed by spring-like member 39. A manually operated push button device 38 having planar base portion 37 is used to move the switch 39 and close the circuit for generating the musical sounds. After the circuit is closed, the musical sounds will play for a predetermined time period. When the button is released, the spring-like switch 39 returns the push button 38 to its initial position. Preferably, the stem portion 41 of the push button forms the nose of the head and face design.

The elongated member 12, head and face portion 18 and cover 24 may be formed from any suitable injection moldable plastic material such as polyvinylchloride, ABS, or the like. The protective package 42 is preferably formed from a clear polyvinylchloride film Which is flexible enough to accommodate movement of the push button device 38 and the switch 39.

The toothbrush may be formed using any number of different molding techniques known in the art. For example, the elongated member 12, the head and face portion 18 and the cover 24 may be formed using three separate molds. The portion 18 may thereafter be joined to the member 12 using a heat bonding technique. Alternatively, a single mold may be used to form the member 12 and the head and face portion as a single unit.

As can be seen from the foregoing, a toothbrush is provided which will stimulate the visual and auditory senses of a user. It is believed that children will find brushing their teeth to be a more pleasurable experience by using the novel toothbrush of the present invention. Should a child tire of the musical tune being generated, it is possible to remove the sound generator 28 and its surrounding casing and replace it with a new sound generator and casing.

It is apparent that there has been provided in accordance with this invention a musical toothbrush which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A toothbrush comprising:

a set of bristles for cleaning a user's teeth;

a handle portion comprising an elongated portion with a series of aligned holes for receiving said set of bristles and a hollow compartment;

means for generating an audible sound located within said compartment;

an opening in a first wall of said compartment through which said sound emanates;

said sound generating means comprising an electrical circuit for generating musical sounds for a predetermined time period and a spring-like actuating switch for actuating said circuit;

said circuit and said switch being encased within an impermeable membrane to prevent water damage to said circuit and said switch; and manual means for initiating the generation of said musical sounds, said manual means extending through a second wall of said compartment said hollow compartment having a removable cover forming at least a portion of said first wall and a plurality of bores; and said cover having a plurality of spaced apart pin connectors for mating with said bores; and further wherein said cover has at least one inwardly projecting support for positioning and supporting said sound generating means in said compartment.

2. A toothbrush according to claim 1 wherein said material comprises a flexible, plastic film material.

3. A toothbrush according to claim 1 further comprising:

said hollow compartment being in the shape of a head and a face; and said manual means forming a portion of said face.

4. A toothbrush according to claim 1 further comprising:

at least a portion of said first wall being formed by a removable cover plate having an aperture through which sound emanating from said sound generating means can be heard.

5. A toothbrush according to claim 1 wherein said handle portion has the shape of a teddy bear head and face.

6. A toothbrush according to claim 1 further comprising:

said manual actuation means having a portion for contacting said switch; and said switch contacting portion being located within said compartment and externally of said impermeable membrane.

7. A toothbrush according to claim 1 wherein said first and second walls are opposed to each other.

* * * * *